US005680038A

United States Patent [19]

Fiedler

[11] Patent Number: 5,680,038

[45] Date of Patent: Oct. 21, 1997

[54] HIGH-SWING CASCODE CURRENT MIRROR

[75] Inventor: Alan S. Fiedler, Minneapolis, Minn.

[73] Assignee: LSI Logic Corporation, Milpitas, Calif.

[21] Appl. No.: 667,071

[22] Filed: Jun. 20, 1996

[51] Int. Cl.[6] ..... G05F 3/16

[52] U.S. Cl. ..... 323/315; 327/538

[58] Field of Search ..... 323/312, 315, 323/316; 330/288, 296, 310, 277; 327/530, 538

[56] References Cited

U.S. PATENT DOCUMENTS

| | | | |
|---|---|---|---|
| 3,875,430 | 4/1975 | Prak | 307/297 |
| 4,281,261 | 7/1981 | Adam | 307/270 |
| 4,297,646 | 10/1981 | LoCascio et al. | 330/288 |
| 4,345,217 | 8/1982 | Pace | 330/288 |
| 4,412,186 | 10/1983 | Nagano | 330/288 |
| 4,471,292 | 9/1984 | Schenck et al. | 323/315 |
| 4,528,494 | 7/1985 | Bloomer | 323/237 |
| 4,550,284 | 10/1985 | Sooch | 323/315 |
| 4,580,088 | 4/1986 | Bloomer | 323/238 |
| 4,583,037 | 4/1986 | Sooch | 323/315 |
| 4,591,804 | 5/1986 | van Tuijl | 330/288 |
| 4,983,929 | 1/1991 | Real et al. | 330/288 |
| 5,003,198 | 3/1991 | Bell | 307/315 |
| 5,099,205 | 3/1992 | Lewyn | 330/288 |
| 5,311,115 | 5/1994 | Archer | 323/315 |
| 5,359,296 | 10/1994 | Brooks et al. | 330/288 |
| 5,373,228 | 12/1994 | Holle | 323/315 |

OTHER PUBLICATIONS

Heim, P. et al., "MOS cascode–mirror biasing circuit operating at any current level with minimal output saturation voltage," *Electronics Letters,* vol. 31, No. 9, 27 Apr. 1995, pp. 690–691.

Zarabadil, Seyed et al., "Very–High–Output–Impedance Cascode Current Sources/Current Mirrors/Transresistance Stages and Their Applications," *International Journal of Circuit Theory and Applications,* vol. 20, (1992), pp. 639–648.

Yang, Howard C. et al., "An Active–Feedback Cascode Current Source," *IEEE Transactions on Circuits and Systems,* vol. 37, No. 5, May 1990, pp. 644–647.

Davidson J. Courtney, "MOS Current Sources—A Comparison and Evaluation," *IEEE,* (1984), pp. 1215–1219.

*Primary Examiner*—Adolf Berhane

*Attorney, Agent, or Firm*—Westman, Champlin & Kelly, P.A.

[57] ABSTRACT

A high-swing current mirror includes a cascode current source and a current source bias circuit. The current source includes first and second bias terminals and an output terminal. The bias circuit includes transistors M1, M2A, M2B and M3A. Transistor M1 has a gate, source, and drain, with the gate coupled to the drain. Transistor M2A has a gate, source, and drain, with the gate and source of transistor M2A coupled to the gate and source, respectively, of transistor M1. Transistor M2B has a gate and drain coupled to one another and to the second bias terminal and a source coupled to the drain of transistor M2A. Transistor M3A has a gate and drain coupled together and to the first bias terminal and a source coupled to the sources of transistors M1 and M2A. The transistors in the cascode current source and current source bias circuit have ratios of device transconductance parameters such that the cascode current source remains in saturation to provide the highest possible voltage swing at the output terminal.

14 Claims, 6 Drawing Sheets

HIGH-SWING CASCODE CURRENT MIRROR

BACKGROUND OF THE INVENTION

The present invention relates to semiconductor integrated circuits and, more particularly, to a high-swing cascode current mirror.

Current sources are used in a variety of applications, including current mirrors which receive an input current and reproduce the input current on an output. An ideal current source has a high parallel output resistance such that the current source generates a current which is constant and nearly independent of the voltage at its output. This output current should also be relatively independent of temperature, power supply voltage and semiconductor process parameters. The output voltage at which the output current and parallel output resistance begin to drop is referred to as the current source's "compliance" voltage, below which one or more transistor devices in the current source typically have gone out of saturation. A low compliance voltage is preferred.

A basic current mirror is formed by two MOS transistors. The first transistor is coupled as a diode-connected device and generates a bias voltage in response to an input current. The second transistor has a gate coupled to the bias voltage and generates an output current at its drain which is proportional to the input current. Such a current mirror has a reasonably good compliance voltage, which is equal to the drain-source saturation voltage ($V_{DS,SAT}$) of the second transistor, but has a low output resistance.

Several improvements have been made to the basic current mirror, but these improvements still have one or more significant disadvantages. These disadvantages include a low output resistance, a high compliance voltage, and/or a compliance voltage which is poorly controlled relative to an optimum compliance voltage over changes in process, voltage, temperature and input currents.

SUMMARY OF THE INVENTION

The high-swing current mirror of the present invention achieves both a high output resistance and an optimum compliance voltage regardless of input current level, temperature, power supply voltage and semiconductor process parameters. The high-swing current mirror includes a cascode current source and a current source bias circuit. The current source includes first and second bias terminals and an output terminal. The current source bias circuit includes transistors M1, M2A, M2B and M3A. Transistor M1 has its gate and drain coupled to one another. The gate and source of transistor M2A are coupled to the gate and source, respectively, of transistor M1. Transistor M2B has its gate and drain coupled to one another and to the second bias terminal and a source coupled to the drain of transistor M2A. Transistor M3A has its gate and drain coupled to the first bias terminal and its source coupled to the sources of transistors M1 and M2A.

Transistor M1 has a device transconductance parameter $K_{M1}$ and a drain current $I_{IN1}$; transistor M2A has a device transconductance parameter $K_{M2A}$ and a drain current $I_{IN2}$; and transistor M3A has a device transconductance parameter $K_{M3A}$ and a drain current $I_{IN3}$. In a preferred embodiment of the present invention, the parameters $K_{M1}$, $K_{M2A}$, $K_{M3A}$, $I_{IN1}$, $I_{IN2}$ and $I_{IN3}$ are selected according to the following equation:

$$\frac{K_{M1}}{K_{M2A}} \cdot \frac{I_{IN2}}{I_{IN1}} = 1 - \left(1 - \sqrt{\frac{K_{M1}}{K_{M3A}} \cdot \frac{I_{IN3}}{I_{IN1}}}\right)^2$$

Such a selection ensures that the cascode current source stage remains in saturation while providing the highest possible voltage swing at the output terminal.

DETAILED DESCRIPTION OF THE PREFERRED EMBODIMENTS

Figure 1A:
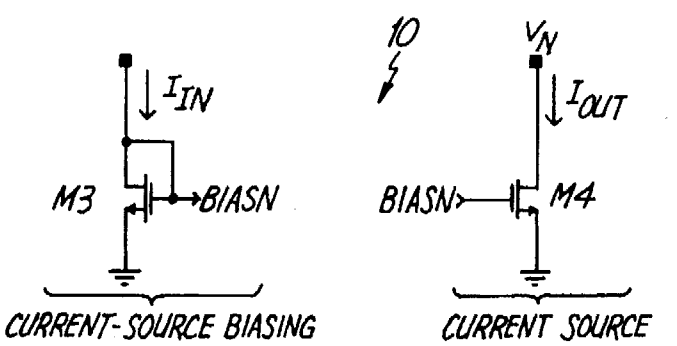
Fig. 1A PRIOR ART
FIGS. 1A–1E are schematic diagrams illustrating various current mirrors of the prior art.

FIGS. 1A–1E are schematic diagrams illustrating various current mirrors of the prior art. For simplicity and ease of description, the same reference numerals have been used in each of the figures to indicate similar elements. For example, the transistor numbering pattern has been repeated to indicate similarity between a position or function of a transistor in one figure and a position or function of a similarly numbered transistor in another figure.

In FIG. 1A, current mirror 10 is a basic current mirror which includes a current source biasing circuit formed with a diode-connected MOS transistor M3 and an output current source formed with a single output transistor M4. Transistor M3 receives a reference current $I_{IN}$ and responsively generates a bias voltage BIASN. Transistor M4 receives the bias voltage BIASN at its gate and generates an output current $I_{OUT}$ at its drain. If. the sizes of M3 and M4 are the same, output current $I_{OUT}$ is approximately equal to the reference current $I_{IN}$. Current mirror 10 has a good compliance voltage, equal to the drain-source saturation voltage $V_{DS,SAT}$ of transistor M4, but has a low output resistance.

Figure 1B:
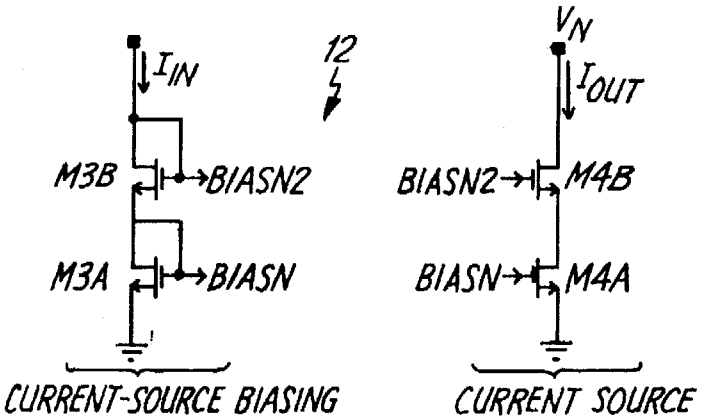
Fig. 1B PRIOR ART

FIG. 1B illustrates a basic cascode current mirror 12. The output current source has two transistors M4A and M4B which are coupled in series with one another. Transistors M3A and M3B generate bias voltages BIASN and BIASN2 for transistors M4A and M4B, respectively. Cascode current mirror 12 has a much higher output resistance than current mirror 10 (shown in FIG. 1A) due to cascode transistor M4B. However, its compliance voltage is fairly high, and is equal to $2V_{DS,SAT}+V_T$, where $V_{DS,SAT}$ is the drain-source saturation voltage and $V_T$ is the threshold voltage.

Figure 1C:
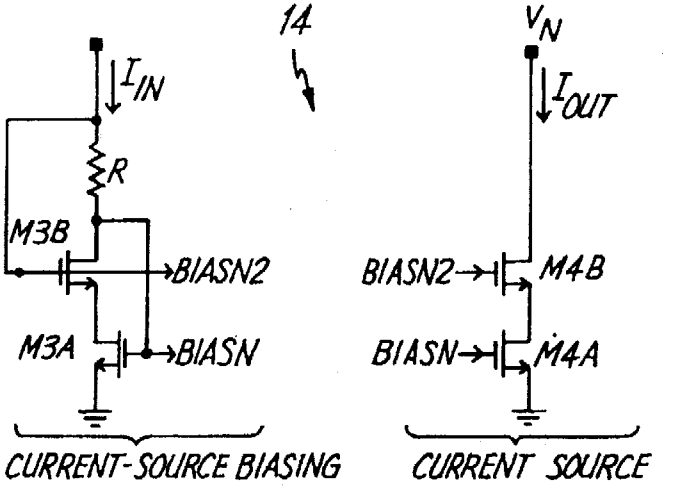
Fig. 1C PRIOR ART

In FIG. 1C, cascode current mirror 14 has a resistor R added in series with transistor M3B. The gate of transistor M3A is now connected to the drain of transistor M3B. The gate of transistor M3B is connected to the drain of transistor M3B, through resistor R. The current $I_{IN}$ through resistor R results in a BIASN2 voltage which is $I_{IN}$*R volts higher than BIASN. With an appropriate selection of R, the drain voltage of M4A is greater than $V_{DS,SAT}$, and cascode current mirror 14 has a high output resistance. However, the generated BIASN2 voltage is not always optimum. Under some conditions, BIASN2 will be too low, causing transistor M4A to operate in its linear region, which results in a low output resistance. Under other conditions, BIASN2 will be too high, which results in an unacceptably high compliance voltage.

Figure 1D:
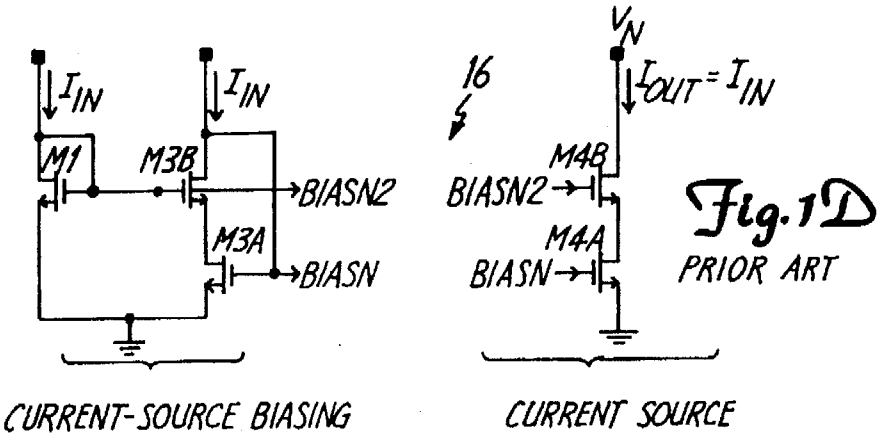
Fig. 1D PRIOR ART

In FIG. 1D, cascode current mirror 16 receives two equal reference currents $I_{IN}$. Transistor M1 generates bias voltage BIASN2 in response to the first reference current $I_{IN}$ while transistor M3A generates bias voltage BIASN in response to the second reference current $I_{IN}$. The objective of the current-source bias circuit in FIG. 1D is to hold the voltage at the drain of transistor M4A near $V_{DS,SAT}$, relatively independent of reference current $I_{IN}$, output voltage $V_N$, process parameters and temperature. The following analysis illustrates that although the circuit shown in FIG. 1D is an improvement over the circuits shown in FIGS. 1A–1C, the circuit still has significant drawbacks. In the analysis, all transistors are assumed to operate in saturation ($V_{DS} \geqq V_{DS,SAT}$). Also, the slope of the current-voltage (I-V) curve for each transistor is assumed to be zero in saturation, which assumes an infinite output resistance. Although the purpose of the circuit is to increase the circuit's output resistance above that of a single-transistor current source, the output resistance is actually not infinite. However, this assumption will simplify analysis while allowing for a valid conclusion. Since all transistors are in saturation, their outputs obey the relation $$I_D = K(V_{GS} - V_T)^2 = K'\frac{W}{L}(V_{GS} - V_T)^2 \quad \text{Eq. 1}$$

$$(\text{when } V_{DS} \geqq V_{DS,SAT} = V_{GS} - V_T)$$

In Equation 1, $I_D$ is the drain current, K is the device transconductance parameter, $V_{GS}$ is the gate-source voltage, $V_T$ is the device threshold voltage, $V_{DS}$ is the drain-source voltage and $V_{DS,SAT}$ is the drain-source saturation voltage. The device transconductance parameter K is defined as K=K'(W/L), where W is the gate width, L is the gate length and K' is the process transconductance parameter, defined by the well-known relation $$K' = \frac{\mu_n C_{ox}}{2} \quad \text{Eq. 2}$$

where $\mu_n$ is the electron mobility and $C_{ox}$ is the gate oxide capacitance per unit area.

Solving Equation 1 for $V_{GS}$ and applying the resulting equation to transistors M1, M4A and M4B in FIG. 1D, $$V_{GS,M1} = \sqrt{\frac{I_{IN}}{K_{M1}}} + V_{T,M1} \quad \text{Eq. 3}$$

$$V_{GS,M4A} = \sqrt{\frac{I_{IN}}{K_{M4A}}} + V_{T,M4A} \quad \text{Eq. 4}$$

$$V_{GS,M4B} = \sqrt{\frac{I_{IN}}{K_{M4B}}} + V_{T,M4B} \quad \text{Eq. 5}$$

Note that input drain currents into M1, M3B and M3A are each assumed equal to $I_{IN}$, and that transistors M4A and M4B are assumed to be the same size as transistors M3A and M3B, respectively, giving $I_{OUT}=I_{IN}$. When these assumptions are not made, the analysis is more cumbersome, but the result is similar, and the forthcoming conclusions can still be reached. From FIG. 1D, note that $$V_{DS,M4A} = V_{GS,M1} - V_{GS,M4B} \quad \text{Eq. 6}$$

Also note that the desired condition can be stated as $$V_{DS,M4A} = V_{DS,M4A,SAT} = V_{GS,M4A} - V_{T,M4A} \quad \text{Eq. 7}$$

Combining Equations 3–7 then gives the result $$\left(\sqrt{\frac{I_{IN}}{K_{M1}}} + V_{T,M1}\right) - \left(\sqrt{\frac{I_{IN}}{K_{M4B}}} + V_{T,M4B}\right) = \sqrt{\frac{I_{IN}}{K_{M4A}}} \quad \text{Eq. 8}$$

Rearranging then leads to $$\sqrt{\frac{1}{K_{M4A}}} + \sqrt{\frac{1}{K_{M4B}}} - \sqrt{\frac{1}{K_{M1}}} = \frac{V_{T,M1} - V_{T,M4B}}{\sqrt{I_{IN}}} \quad \text{Eq. 9}$$

If the gate length of all transistors are such that the differences in K' and $V_T$ (due to short-channel effects) can be neglected, and $V_T$ shifts due to the body effect are eliminated by making all transistors source-substrate connected, Equation 9 can be simplified to a relation defining the relative transistor geometries in FIG. 1D which, when satisfied, gives the desired condition $V_{DS,M4A}=V_{DS,M4A,SAT}$:

$$\sqrt{\frac{L_{M4A}}{W_{M4A}}} + \sqrt{\frac{L_{M4B}}{W_{M4B}}} = \sqrt{\frac{L_{M1}}{W_{M1}}} \quad \text{Eq. 10}$$

In many instances, however, this simplification will result in significant error. In a typical application, the length of transistors M3A and M4A will be chosen to be significantly greater than the minimum gate length so as to produce an accurate, predictable output current $I_{OUT}$ with a low standard deviation in the face of process variations. In addition, a minimum gate length for transistors M3B and M4B is desirable, affording a lower $V_{DS,SAT}$ for a given gate width, or a lower drain capacitance for a given $V_{DS,SAT}$, as compared to a longer transistor. Because of short-channel effects in transistors M3B and M4B, coupled with the unavailability of source-substrate connections for n-channel MOSFETs in a typical N-well digital CMOS process, $K_{M4A}' \neq K_{M4B}'$, and $V_{T,M1} \neq V_{T,M4B}$, and the simplifications cannot be made. Selecting appropriate transistor sizes for this circuit and still achieving the optimum $V_{DS,M4A}=V_{DS,M4A,SAT}$ over variations in current level, process and temperature becomes virtually impossible.

Figure 1E:
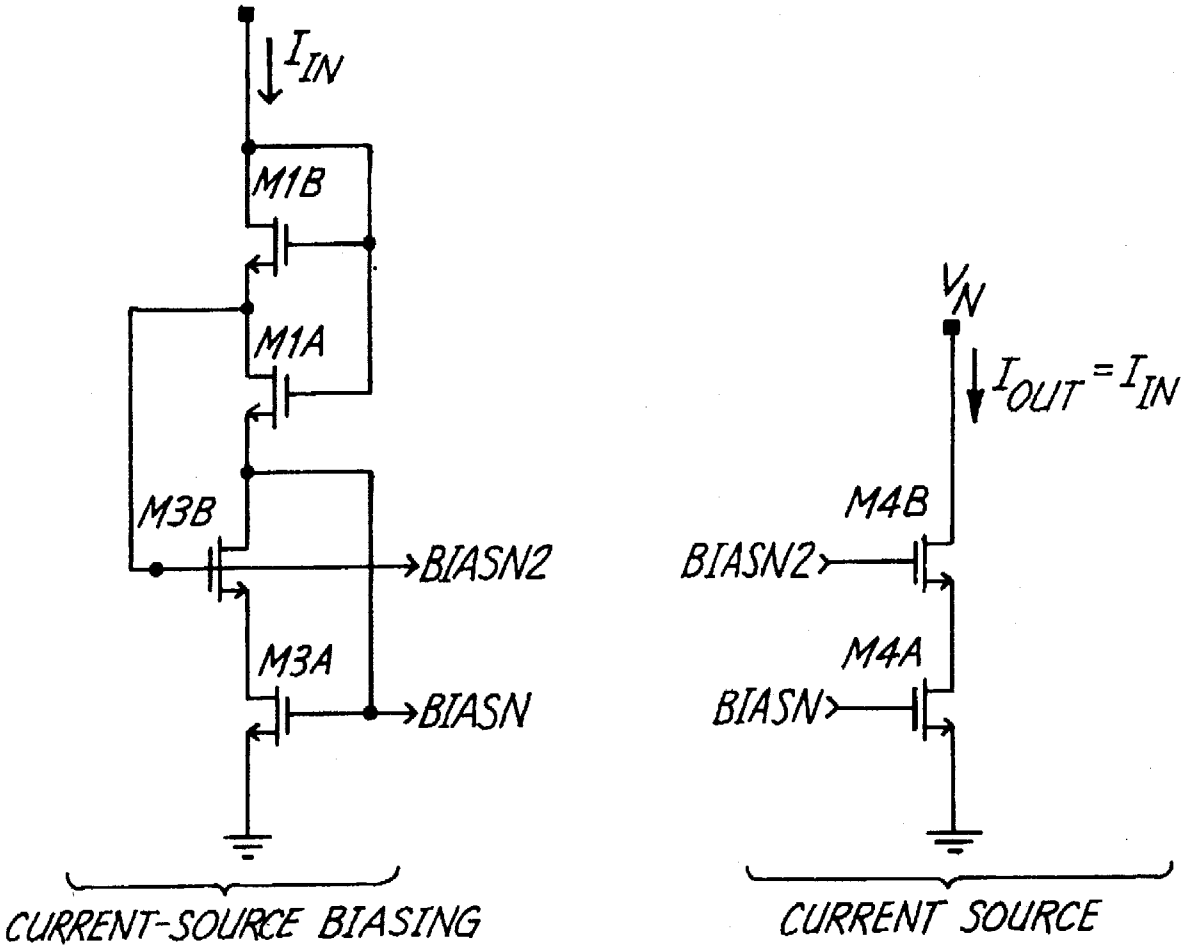
Fig. 1E PRIOR ART

A similar analysis applied to the circuit shown in FIG. 1E shows that the optimum condition $V_{DS,M4A}=V_{DS,M4A,SAT}$ is achieved when all transistors but transistor M1A are the same size, and transistor M1A is ⅓ the width of the other transistors. However, this result is achieved only if all the transistors are of equal length (or sufficiently long such that variations in K' and $V_T$ between transistors of different length are small) and all transistors are source-substrate connected. This is achievable only with a twin-well process, which is typically not available on a standard digital CMOS process. The current mirror shown in FIG. 1E has a well-controlled and optimum output compliance voltage, which is equal to $2V_{DS,SAT}$, assuming the above conditions are met.

Figure 2:
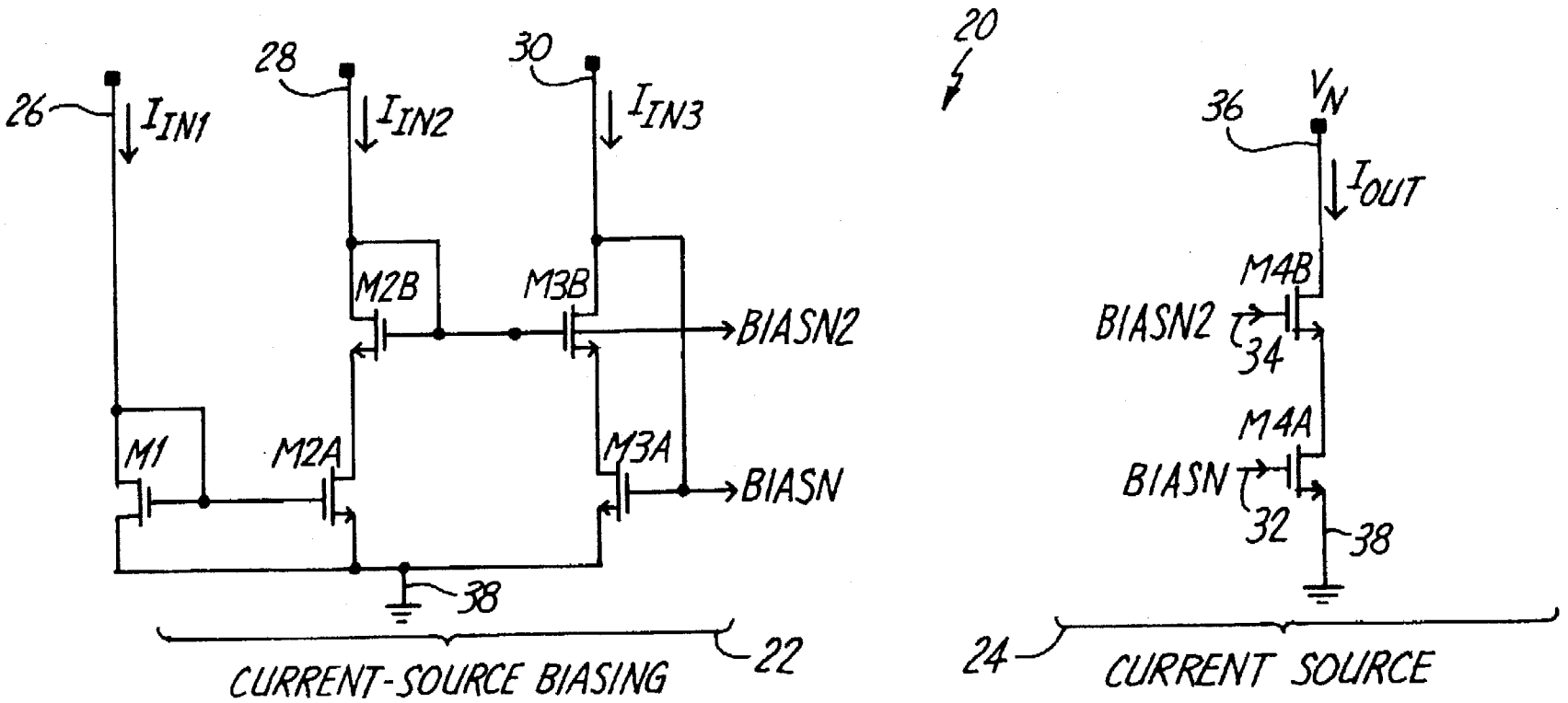
FIG. 2 is a schematic diagram illustrating the current mirror of the present invention.

The current mirror of the present invention avoids the problems existing in the circuits shown in FIGS. 1A–1E. The current mirror of the present invention achieves both a high output resistance and an optimum compliance voltage regardless of transistor gate length, current level, temperature, power supply voltage and semiconductor process parameters. FIG. 2 is a schematic diagram illustrating the current mirror of the present invention. Current mirror 20 includes a current source biasing circuit 22 and a cascode current source 24. Biasing circuit 22 receives reference currents $I_{IN1}$, $I_{IN2}$ and $I_{IN3}$ on input terminals 26, 28 and 30 and responsively generates bias voltages BIASN and BIASN2 on bias terminals 32 and 34, respectively. In one embodiment, reference currents $I_{IN1}$, $I_{IN2}$ and $I_{IN3}$ are substantially equal to one another and have a current level $I_{IN}$. However, equal currents are not required. Current source 24 receives bias voltages BIASN and BIASN2 on terminals 32 and 34 and generates an output current $I_{OUT}$ on output terminal 36, which is substantially equal or proportional to $I_{IN3}$. Reference currents $I_{IN1}$, $I_{IN2}$ and $I_{IN3}$ are preferably generated by one or more current mirrors according to the present invention or can be generated by a variety of well-known current sources.

Current source biasing circuit 22 includes NMOS transistors M1, M2A, M2B, M3A and M3B. Transistor M1 is coupled as a diode between input terminal 26 and ground terminal 38. Transistor M1 has a drain coupled to input terminal 26, a gate coupled to the drain and a source coupled to ground terminal 38. Transistor M2A has a gate coupled to the gate of transistor M1, a source coupled to ground terminal 38 and a drain coupled to the source of transistor M2B. Transistor M2B is coupled as a diode between input terminal 28 and the drain of transistor M2A. Transistor M2B has a drain coupled to input terminal 28 and a gate coupled to the drain. Transistor M3A has a gate coupled to bias terminal BIASN, a source coupled to ground terminal 38 and a drain coupled to the source of transistor M3B. Transistor M3A is coupled as a diode, with its gate coupled to its drain through transistor M3B. Transistor M3B has a gate coupled to the gate of transistor M2B and a drain coupled to input terminal 30 and to the gate of transistor M3A. Transistor M3B is optional. In an alternative embodiment, transistor M3B is removed, with the drain of transistor M3A being connected directly to input terminal 30 and to the gate of transistor M3A.

Current source 24 includes NMOS transistors M4A and M4B. Transistor M4A has a gate coupled to bias terminal BIASN, a source coupled to ground terminal 38 and a drain coupled to the source of transistor M4B. Transistor M4B is coupled in cascode with transistor M4A and has a gate coupled to bias terminal BIASN2 and a drain coupled to output terminal 36.

For the purposes of analysis, the following well-known equations describing the DC current-voltage (I-V) characteristics for a field-effect transistor are used $$I_D = 2K\left(V_{GS} - V_T - \frac{V_{DS}}{2}\right)V_{DS} \text{ (when } V_{DS} \leqq V_{DS,SAT} = V_{GS} - V_T) \quad \text{Eq. 11}$$

$$I_D = K(V_{GS} - V_T)^2 \text{ (when } V_{DS} \geqq V_{DS,SAT} = V_{GS} - V_T) \quad \text{Eq. 12}$$

The objectives of the current source biasing circuit 22 are twofold. First, the bias voltage BIASN2 should be high enough such that transistor M4A is in saturation, but not excessively high, as this will reduce the voltage swing of output voltage $V_N$ at output terminal 36 over which transistor M4B will remain in saturation. Transistor M4A preferably remains in saturation so that current source 20 achieves the full benefits of the cascode bias transistor M4B. Second, current source biasing circuit 22 should ideally maintain bias voltage BIASN2 at an optimum level, independent of the output current level $I_{OUT}$, process (e.g. K' and $V_T$), temperature and power supply voltage. The "optimum" level of BIASN2 is the level at which $V_{DS,M4A} = V_{DS,M4A,SAT}$.

Referring to FIG. 2, transistors M1, M2A, M2B, M3A, M3B, M4A and M4B have gate widths $W_{M1}$, $W_{M2A}$, $W_{M2B}$, $W_{M3A}$, $W_{M3B}$, $W_{M4A}$ and $W_{M4B}$, respectively, and have gate lengths $L_{M1}$, $L_{M2A}$, $L_{M2B}$, $L_{M3A}$, $L_{M3B}$, $L_{M4A}$ and $L_{M4B}$, respectively. The corresponding device transconductance parameters are defined as $$K_{M1} = K_{M1}'\left(\frac{W_{M1}}{L_{M1}}\right), \quad \text{Eq. 13}$$

$$K_{M2A} = K_{M2A}'\left(\frac{W_{M2A}}{L_{M2A}}\right), K_{M2B} = K_{M2B}'\left(\frac{W_{M2B}}{L_{M2B}}\right),$$

$$K_{M3A} = K_{M3A}'\left(\frac{W_{M3A}}{L_{M3A}}\right), K_{M3B} = K_{M3B}'\left(\frac{W_{M3B}}{L_{M3B}}\right),$$

$$K_{M4A} = K_{M4A}'\left(\frac{W_{M4A}}{L_{M4A}}\right), K_{M4B} = K_{M4B}'\left(\frac{W_{M4B}}{L_{M4B}}\right)$$

If the length of transistors M1, M2A, M3A and M4A are equal (or unequal but long enough that short channel effects can be neglected), and since the source and bulk connections of each of these transistors are connected to the same potential (ground terminal 38), K' and $V_T$ of these transistors are then identical. That is, $$K' = K_{M1}' = K_{M2A}' = K_{M3A}' = K_{M4A}', \quad \text{Eq. 14}$$

and $$V_T = V_{T,M1} = V_{T,M2A} = V_{T,M3A} = V_{T,M4A} \quad \text{Eq. 15}$$

As a diode-connected device, transistor M1 is in saturation, and Equation 12 applies. Solving Equation 12 for $V_{GS} - V_T$ results in $$V_{GS,M1} - V_T = \sqrt{\frac{I_{IN1}}{K_{M1}}} \quad \text{Eq. 16}$$

In a preferred embodiment, $K_{M2A}$ is chosen to be greater than $K_{M1}$ ($K_{M2A} > K_{M1}$), which forces transistor M2A into its linear region, such that Equation 11 applies. Applying Equation 11 to transistor M2A results in $$I_{IN2} = 2K_{M2A}\left(V_{GS,M2A} - V_T - \frac{V_{DS,M2A}}{2}\right)V_{DS,M2A} \quad \text{Eq. 17}$$

Noting that $V_{GS,M1} = V_{GS,M2A}$ and applying Equation 16

$$I_{IN2} = 2K_{M2A}\left(\sqrt{\frac{I_{IN1}}{K_{M1}}} - \frac{V_{DS,M2A}}{2}\right)V_{DS,M2A} \quad \text{Eq. 18}$$

Solving for $V_{DS,M2A}$, Equation 18 becomes $$V_{DS,M2A} = \sqrt{\frac{I_{IN1}}{K_{M1}}}\left(1 - \sqrt{1 = \frac{K_{M1}}{K_{M2A}} \cdot \frac{I_{IN2}}{I_{IN1}}}\right) \quad \text{Eq. 19}$$

Applying the desired condition that the drain voltage of transistor M3A be such that transistor M3A is just in saturation (i.e., $V_{DS,M3A} = V_{DS,M3A,SAT}$), Equation 12 gives the result $$V_{DS,M3A} = V_{DS,M3A,SAT} = V_{GS,M3A} - V_T = \sqrt{\frac{I_{IN3}}{K_{M3A}}} \quad \text{Eq. 20}$$

In FIG. 2, $V_{GS,M2B}$ preferably equals $V_{GS,M3B}$ such that $V_{DS,M2A} = V_{DS,M3A}$. This condition will occur if the device transconductance parameters and drain currents are selected according to the following equation $$K_{M3B} = K_{M2B} \cdot \frac{I_{IN3}}{I_{IN2}} \quad \text{Eq. 21}$$

In one embodiment, transistor M2B and transistor M3B have equal drain currents and are the same size, i.e., $W_{M2B} = W_{M3B}$ and $L_{M2B} = L_{M3B}$. With Equation 21 satisfied, giving $V_{DS,2A}=V_{DS,M3A}$, Equations 19 and 20 are then combined to obtain $$\sqrt{\frac{I_{IN3}}{K_{M3A}}}=\sqrt{\frac{I_{IN1}}{K_{M1}}}\left(1-\sqrt{1-\frac{K_{M1}}{K_{M2A}}\cdot\frac{I_{IN2}}{I_{IN1}}}\right) \quad \text{Eq. 22}$$

Rearranging Equation 22 results in $$\frac{K_{M1}}{K_{M2A}}\cdot\frac{I_{IN2}}{I_{IN1}}=1-\left(1-\sqrt{\frac{K_{M1}}{K_{M3A}}\cdot\frac{I_{IN3}}{I_{IN1}}}\right)^2 \quad \text{Eq. 23}$$

Applying Equations 13 and 14 to Equation 23 and, for simplicity, setting $I_{IN1}=I_{IN2}=I_{IN3}$ and also setting the length of transistors M1, M2A, M3A and M4A all equal then gives the result $$\frac{W_{M1}}{W_{M2A}}=1-\left(1-\sqrt{\frac{W_{M1}}{W_{M3A}}}\right)^2 \quad \text{Eq. 24}$$

Thus, by first choosing a ratio of transistor widths for transistors M1 and M3A, Equation 24 then determines the ratio of transistor widths for transistors M1 and M2A that will result in the optimum condition of $V_{DS,M3A}=V_{DS,M3A,SAT}$, and, if M4A and M4B are scaled proportionately to M3A and M3B, $V_{DS,M4A}=V_{DS,M4A,SAT}$. This relation applies even if the length of transistors M2B, M3B and M4B are chosen to be minimum, and even if these transistors are not source-substrate connected.

For example, choosing transistor M3A to be four times as wide as transistor M1 gives the result $$\frac{W_{M1}}{W_{M2A}}=1-\left(1-\sqrt{\frac{W_{M1}}{4W_{M1}}}\right)^2=0.75 \quad \text{Eq. 25}$$

Choosing $W_{M1}$=6 μm, $W_{M2A}$=8 μm and $W_{M3A}$=24 μm satisfies Equation 24. Exact scaling can be achieved by using multiple instances of the largest common factor, in this case, 2 μm, although at the expense of layout area on the integrated circuit. A compromise would be to build the 24 μm wide transistors out of four 6 μm transistors in parallel, and the 8 μm transistor out of a single 8 μm transistor. The sizes of transistors M4A and M4B can be scaled up or down relative to the sizes of transistors M3A and M3B according to the following equations to scale output current $I_{OUT}$ greater than or less than reference current level $I_{IN3}$ while still maintaining the optimum condition of $V_{DS,M4A}=V_{DS,M4A,SAT}$:

$$\frac{I_{OUT}}{I_{IN3}}=\frac{K_{M4A}}{K_{M3A}}=\frac{W_{M4A}}{W_{M3A}}\cdot\frac{L_{M3A}}{L_{M4A}} \quad \text{Eq. 26}$$

$$\frac{I_{OUT}}{I_{IN3}}=\frac{K_{M4B}}{K_{M3B}}=\frac{W_{M4B}}{W_{M3B}}\cdot\frac{L_{M3B}}{L_{M4B}} \quad \text{Eq. 27}$$

In a preferred embodiment, $L_{M3A}=L_{M4A}$ and $L_{M3B}=L_{M4B}$.

Figure 3:
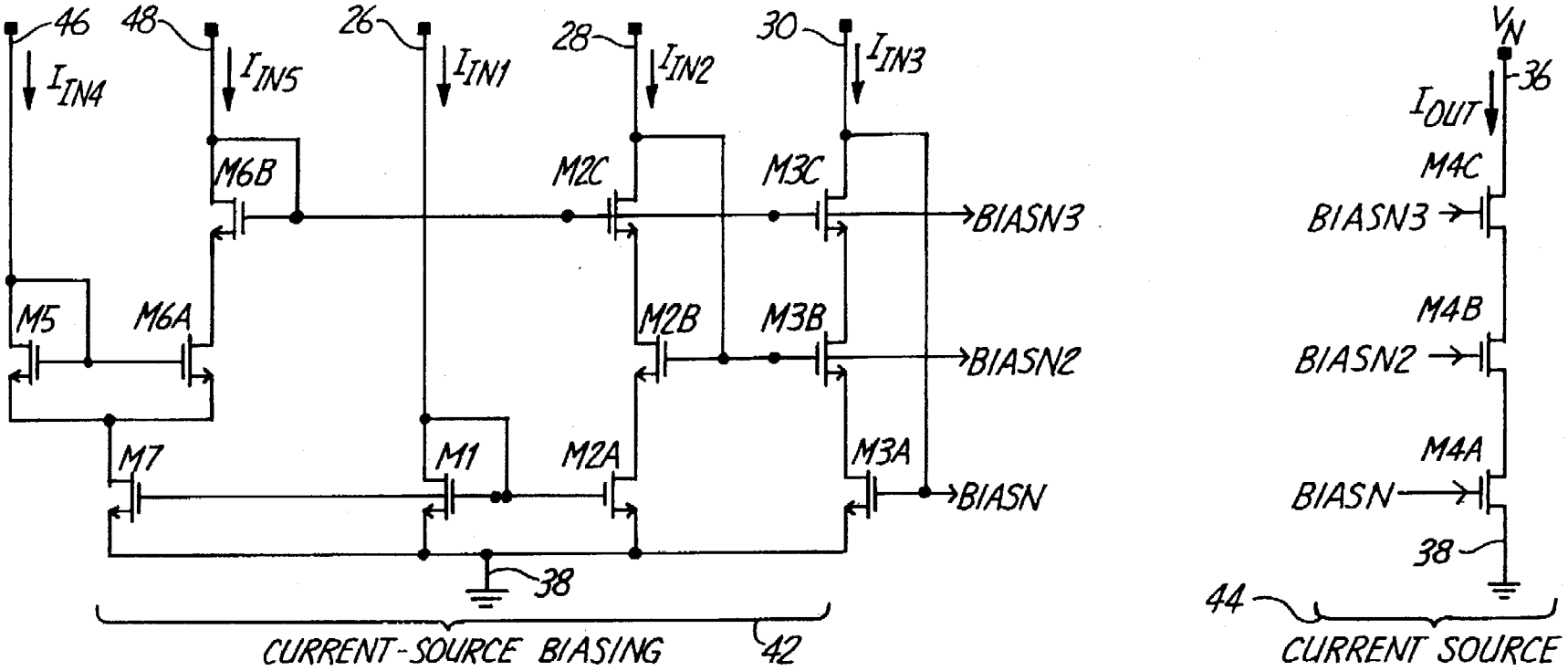
FIG. 3 is a schematic diagram of a double-cascode current mirror according to the present invention.

FIG. 3 is a schematic diagram of a double-cascode current mirror according to the present invention. As in the embodiment shown in FIG. 2, current mirror 40 includes a current source biasing circuit 42 and an output current source 44. Output current source 44 is similar to output current source 24 shown in FIG. 2, but has an additional cascode-connected transistor M4C coupled between output terminal 36 and the drain of transistor M4B. The gate of transistor M4C is biased by a bias voltage BIASN3, which is generated by current source biasing circuit 42.

Bias circuit 42 is also similar to bias circuit 22 shown in FIG. 2, but has an additional circuit portion for generating bias voltage BIASN3. Transistors M1, M2A, M2B, M3A, M3B, M4A and M4B correspond to transistors M1, M2A, M2B, M3A, M3B, M4A and M4B of FIG. 2. Additional transistors M5, M6A, M6B, M3C and M4C are functional equivalents of transistors M1, M2A, M2B, M3B and M4B, respectively. Transistors M5, M6A, M6B, M2C, M3C and M4C have gate widths $W_{M5}$, $W_{M6A}$, $W_{M6B}$, $W_{M2C}$, $W_{M3C}$ and $W_{M4C}$, respectively, and have gate lengths $L_{M5}$, $L_{M6A}$, $L_{M6B}$, $L_{M2C}$, $L_{M3C}$ and $L_{M4C}$, respectively. The corresponding device transconductance parameters are defined as $$K_{M5}=K_{M5}'\left(\frac{W_{M5}}{L_{M5}}\right),\ K_{M6A}=K_{M6A}'\left(\frac{W_{M6A}}{L_{M6A}}\right),\ K_{M6B}=K_{M6B}'\left(\frac{W_{M6B}}{L_{M6B}}\right),\ K_{M2C}=K_{M2C}'\left(\frac{W_{M2C}}{L_{M2C}}\right),\ K_{M3C}=K_{M3C}'\left(\frac{W_{M3C}}{L_{M3C}}\right),\ K_{M4C}=K_{M4C}'\left(\frac{W_{M4C}}{L_{M4C}}\right) \quad \text{Eq. 28}$$

Bias circuit 42 further includes input terminals 26, 28, 30, 46 and 48 which receive reference currents $I_{IN1}$, $I_{IN2}$, $I_{IN3}$, $I_{IN4}$ and $I_{IN5}$, respectively. Input terminals 26, 28 and 30 and input currents $I_{IN1}$, $I_{IN2}$ and $I_{IN3}$ correspond to input terminals 26, 28 and 30 and input currents $I_{IN1}$, $I_{IN2}$, and $I_{IN3}$ in FIG. 2. Reference current $I_{IN3}$ is mirrored into output terminal 36 as output current $I_{OUT}$. Applying a similar analysis to that shown in the derivation of Equations 21 and 23 gives the result that the device transconductance parameters and drain currents of transistors M5, M6A, M6B and M2C are selected according to the following equations $$K_{M2C}=K_{M6B}\cdot\frac{I_{IN2}}{I_{IN5}} \quad \text{Eq. 29}$$

$$K_{M3C}=K_{M6B}\cdot\frac{I_{IN3}}{I_{IN5}} \quad \text{Eq. 30}$$

$$\frac{K_{M5}}{K_{M6A}}\cdot\frac{I_{IN5}}{I_{IN4}}=1-\left(1-\sqrt{\frac{K_{M5}}{K_{M2B}}\cdot\frac{I_{IN2}}{I_{IN4}}}\right)^2 \quad \text{Eq. 31}$$

Transistor M7 raises the voltage at the sources of transistors M5 and M6A to equal the voltage at the sources of transistors M2B, M3B and M4B. Transistor M7 has a gate coupled to the gates of transistors M1 and M2A, a source coupled to ground terminal 38 and a drain coupled to the sources of transistors M5 and M6A. The device transconductance parameter $K_{M7}$ is selected according to the following equation $$K_{M7}=K_{M2A}\left(\frac{I_{IN4}+I_{IN5}}{I_{IN2}}\right) \quad \text{Eq. 32}$$

In one embodiment, currents $I_{IN1}$–$I_{IN5}$ are substantially equal to one another and the device transconductance parameter $K_{M7}$ of transistor M7 is twice the device transconductance parameter $K_{M2A}$ of transistor M2A (such as with $L_{M7}=L_{M2A}$ and $W_{M7}=2W_{M2A}$). Since the drain current of transistor M7 ($I_{D,M7}$) is twice the drain current of transistor M2A ($I_{D,M2A}$), it follows that $V_{DS,M7}=V_{DS,M2A}$ (and also equals $V_{DS,M3A}$ and $V_{DS,M4A}$, by previous analysis). By taking this into account, analysis similar to that shown for the derivation of Equation 24 gives the preferred ratios for transistor widths $W_{M2B}$, $W_{M5}$ and $W_{M6A}$ as $$\frac{W_{M5}}{W_{M6A}}=1-\left(1-\sqrt{\frac{W_{M5}}{W_{M2B}}}\right)^2 \quad \text{Eq. 33}$$

By choosing $W_{M2B}$, $W_{M5}$ and $W_{M6A}$ so as to satisfy Equation 33, the optimum condition of $V_{DS,M3B}=V_{DS,M3B,SAT}$ and, by extension, $V_{DS,M4B}=V_{DS,M4B,SAT}$, results. In the embodiment shown in FIG. 3, transistors M2C, M3B and M3C are optional. These transistors can be eliminated by directly coupling the drains of transistors M2B and M3A to input terminals 28 and 30, respectively.

The sizes of transistors M4A, M4B and M4C can be scaled up or down relative to the sizes of transistors M3A, M3B and M3C according to the following equation and Equations 26 and 27 to scale the output current $I_{OUT}$ relative to $I_{IN3}$ while still maintaining the optimum condition of $V_{DS,M4A}=V_{DS,M4A,SAT}$ and $V_{DS,M4B}=V_{DS,M4B,SAT}$:

$$\frac{I_{OUT}}{I_{IN3}}=\frac{K_{M4C}}{K_{M3C}}=\frac{W_{M4C}}{W_{M3C}}\cdot\frac{L_{M3C}}{L_{M4C}} \quad \text{Eq. 34}$$

In a preferred embodiment, $L_{M3A}=L_{M4A}$, $L_{M3B}=L_{M4B}$ and $L_{M3C}=L_{M4C}$.

Figure 4:
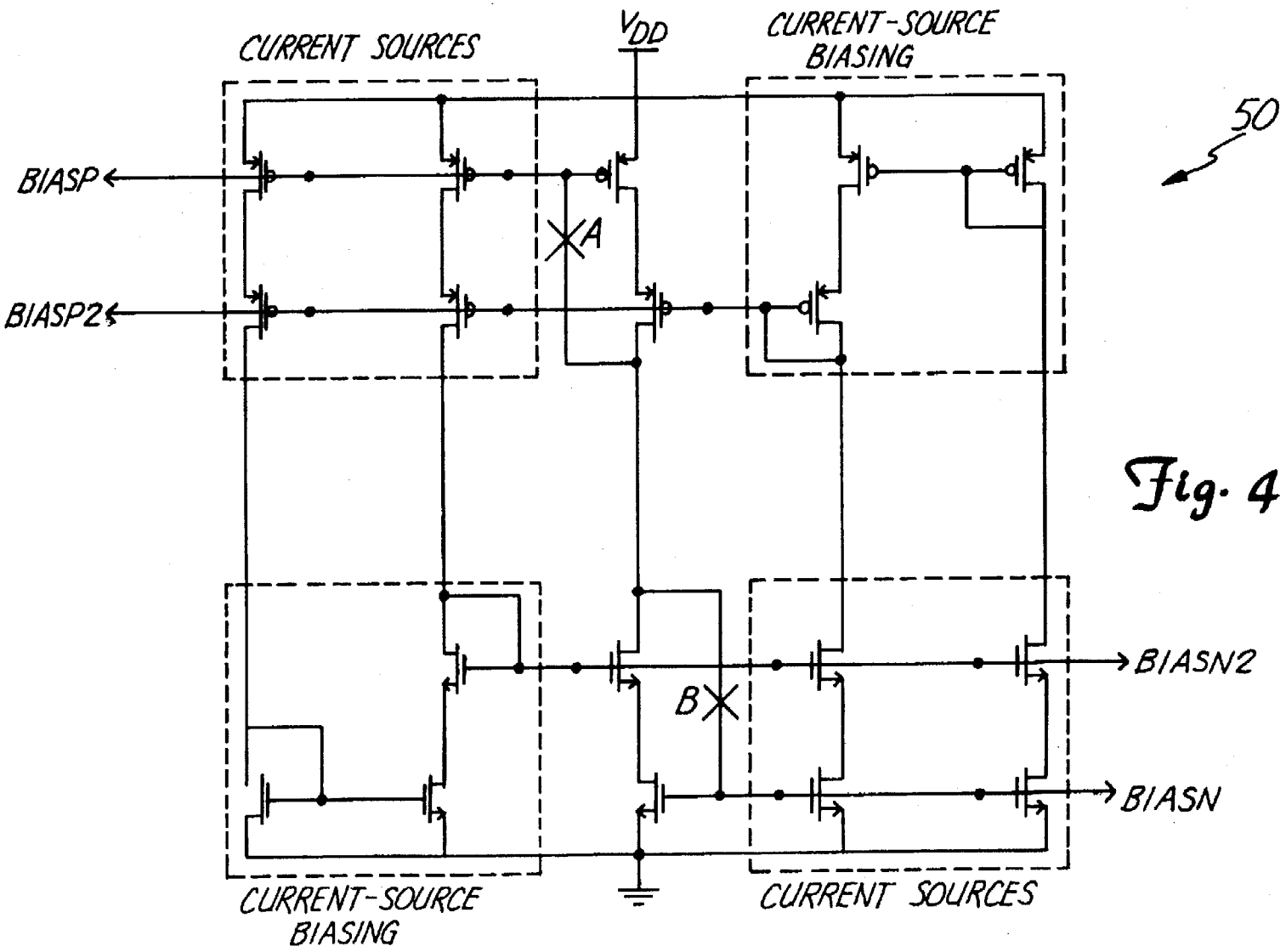
FIG. 4 is a schematic diagram of a single-cascode current biasing circuit having self-generated reference currents according to the present invention.

In the single and double cascode embodiments shown in FIGS. 2 and 3, multiple current sources are used to generate reference currents $I_{IN1}$–$I_{IN5}$ for biasing the n-channel current-source biasing stage. With the present invention, it is straightforward to generate the reference currents with a circuit comprising the complement of the n-channel biasing and current source stages, using p-channel devices. FIG. 4 is a schematic diagram of a single-cascode biasing circuit 50 in which the reference currents are generated by complementary circuits. Circuit 50 requires an input bias voltage, either BIASN or BIASP, to fix the circuit's operating point. If BIASN is used, connection B must be broken. If BIASP is used, connection A must be broken. The BIASN or BIASP voltage can be generated by a current-biased, diode-connected n-channel or p-channel FET, respectively. For example, BIASN can be generated by diode-connected transistor M3A, as shown in FIG. 5.

Figure 5:
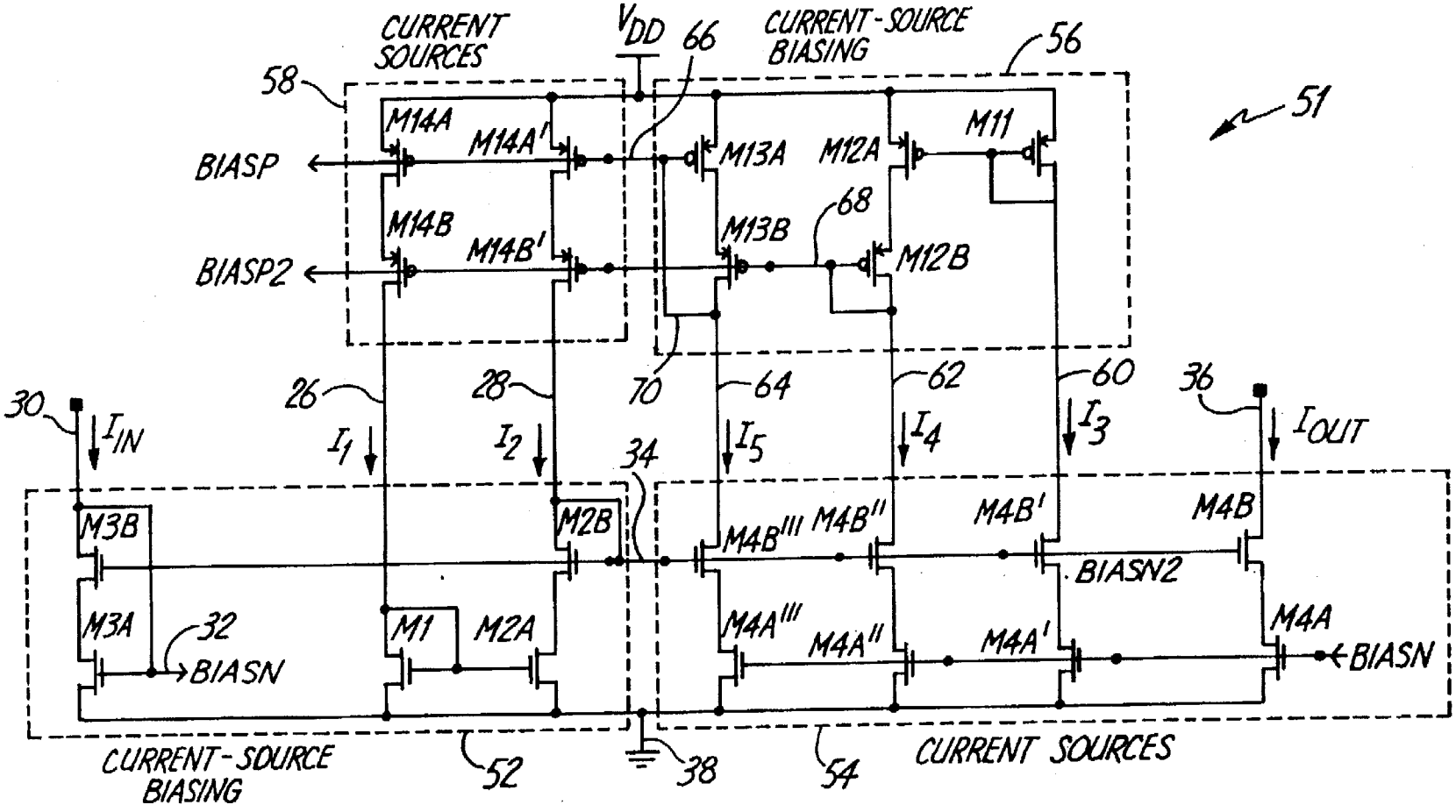
FIG. 5 is a schematic diagram of a current mirror having a single-cascode biasing circuit according to FIG. 4.

FIG. 5 is a schematic diagram of a current mirror 51 having a complete single-cascode biasing circuit according to the present invention. Current mirror 51 includes n-channel current-source biasing circuit 52, n-channel current source circuit 54, p-channel current-source biasing circuit 56 and p-channel current source circuit 58. N-channel current-source biasing circuit 52 corresponds to current-source biasing circuit 22 shown in FIG. 2 and includes similar transistors M1, M2A, M2B, M3A and M3B. Current-source biasing circuit 52 receives an input current $I_{IN}$ on input terminal 30 and generates bias voltages BIASN and BIASN2 on bias terminals 32 and 34, respectively. Current source circuit 54 includes a plurality of parallel current sources formed by transistors M4A and M4B, M4A' and M4B', M4A" and M4B", and M4A'" and M4B'" which generate equal currents $I_{OUT}$ and $I_3$–$I_5$ on terminals 36, 60, 62 and 64, respectively. Each current source is biased by bias voltages BIASN and BIASN2.

Currents $I_3$–$I_5$ on terminals 60, 62 and 64 are provided as input reference currents to p-channel current-source biasing circuit 56. Circuit 56 includes p-channel transistors M11, M12A, M12B, M13A and M13B which generally correspond to n-channel transistors M1, M2A, M2B, M3A and M3B, respectively, of circuit 52 and operate in a similar fashion. Circuit 56 generates bias voltages BIASP and BIASP2 on bias terminals 66 and 68, respectively.

P-channel current source circuit 58 includes a pair of parallel current sources formed by cascode-connected transistors M14A and M14B and M14A' and M14B', respectively, which receive bias voltages BIASP and BIASP2 and responsively generate currents $I_1$ and $I_2$ on terminals 26 and 28 for n-channel current-source biasing circuit 52. P-channel current source circuit 58 generally corresponds to n-channel current source circuit 54 and has a similar function.

The current mirror shown in FIG. 5 can easily be converted to generate input bias voltage BIASP, as opposed to BIASN to fix the current levels in the current mirror. If BIASP is used, connection 70 between the gate of transistors M13A and the drain of transistor M13B is broken (connection A in FIG. 4) and a similar connection is made between the gate of transistor M4A'" and the drain of transistors M4B'" (connection B in FIG. 4). Transistors M3A and M3B are eliminated and are replaced with a complementary circuit comprising p-channel transistors for generating BIASP. Similarly, transistors M4A and M4B are eliminated and replaced with a complementary circuit comprising p-channel transistors for receiving BIASP and BIASP2 and generating output current $I_{OUT}$. If both current sources and sinks are desired, both p-channel and n-channel versions of M4A and M4B are used at the same time, with the n-channel version tied to BIASN and BIASN2 and the p-channel version tied to BIASP and BIASP2.

The high-swing cascode current mirror of the present invention achieves both a high output resistance and an optimum compliance voltage independent of current level, temperature, power supply voltage and semiconductor process parameters. The current mirror can be used to mirror accurately a reference current which may be fixed or vary in time. The current mirror has a very large available voltage swing at the output and works very well for low power supply voltages. The current mirror of the present invention is simple, yet improves performance of any circuit in which it is used.

Although the present invention has been described with reference to preferred embodiments, workers skilled in the art will recognize that changes may be made in form and detail without departing from the spirit and scope of the invention. For example, the current mirror of the present invention can be implemented with various technologies other than MOS technology and with various circuit configurations. Also, the voltage supply terminals can be relatively positive or relatively negative, depending upon the particular convention adopted and the technology used. For example, a circuit comprising n-channel devices can be complemented to include p-channel devices and have a similar operation. The term "coupled" can include various types of connections or coupling and can include a direct connection or a connection through one or more intermediate complements.

What is claimed is:

1. A high-swing current mirror comprising:

a cascode current source having first and second bias terminals and an output terminal;

a bias circuit comprising:

a transistor M1 having a gate, source and drain, with the drain being coupled to the gate;

a transistor M2A having a gate and source coupled to the gate and source, respectively, of the transistor M1 and having a drain;

a transistor M2B having a gate and drain coupled to one another and to the second bias terminal and having a source coupled to the drain of the transistor M2A; and a transistor M3A having a gate and drain coupled to the first bias terminal and a source coupled to the sources of the transistors M1 and M2A.

2. The high-swing current mirror of claim 1 wherein the transistor M1 has a device transconductance parameter $K_{M1}$ and a drain current $I_{IN1}$, the transistor M2A has a device transconductance parameter $K_{M2A}$ and a drain current $I_{IN2}$, and the transistor M3A has a device transconductance parameter $K_{M3A}$ and a drain current $I_{IN3}$, and wherein $K_{M1}$, $K_{M2A}$, $K_{M3A}$, $I_{IN1}$, $I_{IN2}$ and $I_{IN3}$ are selected according to the following equation:

$$\frac{K_{M1}}{K_{M2A}}\cdot\frac{I_{IN2}}{I_{IN1}}=1-\left(1-\sqrt{\frac{K_{M1}}{K_{M3A}}\cdot\frac{I_{IN3}}{I_{IN1}}}\right)^2.$$

3. The high-swing current mirror of claim 2 wherein the cascode current source comprises cascode connected transistors M4A and M4B coupled in series with the output terminal, wherein the transistor M4A has a gate which forms the first bias terminal and wherein the transistor M4B has a gate which forms the second bias terminal.

4. The high-swing current mirror of claim 3 wherein the transistor M4A has a device transconductance parameter $K_{M4A}$ which is equal to the device transconductance parameter $K_{M3A}$.

5. The high-swing current mirror of claim 3 wherein the transistor M2B has a device transconductance parameter $K_{M2B}$ and the transistor M4B has a device transconductance parameter $K_{M6B}$ which is equal to the device transconductance parameter $K_{M2B}$.

6. The high-swing current mirror of claim 2 and further comprising:

a transistor M3B having a gate, source and drain, with the gate coupled to the gate of the transistor M2B; and wherein the gate of the transistor M3A is coupled to the drain of the transistor M3B and wherein the drain of the transistor M3A is coupled to the source of the transistor M3B.

7. The high-swing current mirror of claim 6 wherein the transistor M2B has a device transconductance parameter $K_{M2B}$ and the drain current $I_{IN2}$ and the transistor M3B has a device transconductance parameter $K_{M3B}$ and the drain current $I_{IN3}$, and wherein $K_{M2B}$, $K_{M3B}$, $I_{IN2}$ and $I_{IN3}$ are selected according to the following equation:

$$K_{M3B} = K_{M2B} \cdot \frac{I_{IN3}}{I_{IN2}} .$$

8. The high-swing current mirror of claim 2 and further comprising:

a first reference current source coupled to the drain of the transistor M1 and generating the drain current $I_{IN1}$ at a first current level;

a second reference current source coupled to the drain of the transistor M2B and generating the drain current $I_{IN2}$ at the first current level; and a third reference current source coupled to the drain of the transistor M3A and generating the drain current $I_{IN3}$ at the first current level.

9. The high-swing current mirror of claim 2 wherein:

the cascode current source further has a third bias terminal; and the bias circuit further comprises:

a transistor M5 having a gate, source and drain, with the gate of the transistor M5 coupled to the drain of the transistor M5;

a transistor M6A having a gate, source and drain, with the gate and source of the transistor M6A coupled to the gate and source, respectively, of the transistor M5;

a transistor M6B having a gate and a drain coupled to the third bias terminal, and a source coupled to the drain of the transistor M6A; and a transistor M7 having a gate coupled to the gates of the transistors M1 and M2A, a source coupled to the sources of the transistors M1 and M2A, and a drain coupled to the sources of the transistors M5 and M6A.

10. The high-swing current mirror of claim 9 wherein the transistor M5 has a drain current $I_{IN4}$, the transistors M6A and M6B have a drain current $I_{IN5}$, and the transistor M7 has a device transconductance parameter $K_{M7}$ which is selected according to the following equation:

$$K_{M7} = K_{M2A} \left( \frac{I_{IN4} + I_{IN5}}{I_{IN2}} \right).$$

11. The high-swing current mirror of claim 9 wherein the transistor M5 has a device transconductance parameter $K_{M5}$ and a drain current $I_{IN4}$, the transistor M6A has a device transconductance parameter $K_{M6A}$ and a drain current $I_{IN5}$ and the transistor M2B has a device transconductance parameter $K_{M2B}$ and the drain current $I_{IN2}$, and wherein $K_{M5}$, $K_{M6A}$, $K_{M2B}$, $I_{IN4}$, $I_{IN5}$ and $I_{IN2}$ are selected according to the following equation:

$$\frac{K_{M5}}{K_{M6A}} \cdot \frac{I_{IN5}}{I_{IN4}} = 1 - \left( 1 - \sqrt{\frac{K_{M5}}{K_{M2B}} \cdot \frac{I_{IN2}}{I_{IN4}}} \right)^2 .$$

12. The high-swing current mirror of claim 11 wherein the bias circuit further comprises:

a transistor M2C coupled in cascode to the drain of the transistor M2B and having a gate coupled to the third bias terminal and a drain coupled to the gate of the transistor M2B; and wherein the transistor M6B has a device transconductance parameter $K_{M6B}$ and the drain current $I_{IN5}$ and the transistor M2C has a device transconductance parameter $K_{M2C}$ and the drain current $I_{IN2}$, and wherein $K_{M6B}$, $K_{M2C}$, $I_{IN5}$ and $I_{IN2}$ are selected according to the following equation:

$$K_{M2C} = K_{M6B} \cdot \frac{I_{IN2}}{I_{IN5}} .$$

13. The high-swing current mirror of claim 11 wherein the bias circuit further comprises:

a transistor M3C coupled in cascode to the drain of the transistor M3A and having a gate coupled to the third bias terminal and a drain coupled to the gate of the transistor M3A; and wherein the transistor M6B has a device transconductance parameter $K_{M6B}$ and the drain current $I_{IN5}$ and the transistor M3C has a device transconductance parameter $K_{M3C}$ and the drain current $I_{IN3}$, and wherein $K_{M6B}$, $K_{M3C}$, $I_{IN5}$ and $I_{IN3}$ are selected according to the following equation:

$$K_{M3C} = K_{M6B} \left( \frac{I_{IN3}}{I_{IN5}} \right).$$

14. An integrated circuit comprising:

a cascode current source having first and second bias terminals and an output terminal;

a current source bias circuit comprising:

a first bias circuit portion comprising a first transistor having a gate, a source and a drain, with the gate and drain being coupled to the first bias terminal; and a second bias circuit portion comprising:

a second transistor having a gate, source and drain, with the gate and drain being coupled together and the source coupled to the source of the first transistor;

a third transistor having a gate coupled to the gate of the second transistor, a source coupled to the source of the second transistor and a drain; and a fourth transistor having a gate and a drain coupled to the second bias terminal and a source coupled to the drain of the third transistor.

* * * * *